US005701620A

United States Patent [19]

Montross

[11] Patent Number: 5,701,620

[45] Date of Patent: Dec. 30, 1997

[54] APPARATUS FOR MAKING TWO TWIN/ SINGLE MATTRESSES USABLE AS ONE MATTRESS SYSTEM

[76] Inventor: S. Sam Montross, 1015 Forest Ct., Palo Alto, Calif. 94301

[21] Appl. No.: 779,123

[22] Filed: Jan. 6, 1997

[51] Int. Cl.[6] ..... A47C 21/00; A47C 31/00

[52] U.S. Cl. ..... 5/658; 5/661

[58] Field of Search ..... 5/658, 661, 513, 5/722, 723, 922

[56] References Cited

U.S. PATENT DOCUMENTS

| | | | |
|---|---|---|---|
| 2,879,523 | 3/1959 | Klassen et al. | 5/723 |
| 2,883,683 | 4/1959 | Burk | 5/661 |
| 2,958,874 | 11/1960 | Emery | 5/661 |
| 3,157,889 | 11/1964 | Chanko | 5/658 |
| 3,225,363 | 12/1965 | Kirsch | 5/8 |
| 3,308,492 | 3/1967 | Lovette | 5/723 |
| 4,611,804 | 9/1986 | Addair | 5/922 |
| 5,555,581 | 9/1996 | Woods | 5/658 |

*Primary Examiner*—Alexander Grosz
*Attorney, Agent, or Firm*—Rodger H. Flagg

[57] ABSTRACT

The mattress joining apparatus comprises a seam protector sized to extend the length of a mattress, and to extend over opposing ends of the mattress. A first mattress strap is secured to one end of the seam protector and a second mattress strap is secured to the opposite end of the seam protector. The first and second mattress straps are each sized to extend across the width of the first and second ends of the adjacent mattresses, and to extend at least halfway along the length of the first and second adjacent mattresses. A first releasable securement means is provided to secure one end of the first mattress strap with one end of the second mattress strap. A second releasable securement means is provided to secure the opposite end of the first mattress strap with the opposite end of the second mattress strap. The first and second mattress straps are secured about the thickness of the adjacent first and second mattresses, with the seam protector extending over the adjacent length of the first and second mattresses. The seam protector may alternetly extend to also overlap the thickness of each end of the box springs A first box springs strap may also be secured to one end of the seam protector in spaced relation from the first mattress strap, and a second box springs strap may also be secured to the opposite end of the seam protector in spaced relation from the second mattress strap. The first and second box spring straps are sized to be secured about the first and second box springs, and to be secured by third and fourth releasable securement means. The first and second mattress straps may be sized to extend about a bolster to one end of the first and second mattresses, to extend the length of the adjacent first and second mattresses. Releasable loops may be adapted to secure each rolled up mattress and box springs straps in proximity to the seam protector, which may be rolled into a compact package for ease of transport or storage.

20 Claims, 5 Drawing Sheets

APPARATUS FOR MAKING TWO TWIN/ SINGLE MATTRESSES USABLE AS ONE MATTRESS SYSTEM

BACKGROUND OF THE INVENTION

This invention relates to a mattress joining apparatus which when secured over two twin bed mattresses allows the sleeper to sleep as though the two twin/single bed mattresses were one bed, approximately as wide as a King sized mattress. When traveling, couples are often forced to accept the sleeping arrangement of two twin/single beds although preferring to sleep together on one wide mattress. However, single mattresses are plentiful, and may be releasably joined with this mattress connecting apparatus, without modification or damage to an existing pair of twin/single mattresses. The mattress connecting apparatus disclosed herein, is inexpensive to manufacture, easy to transport, and useful to home owners, renters, travelers, cruise ships, and motel and hotel management to provide flexibility in temporarily converting two adjacent twin/single mattresses to a joined wider mattress to suit the needs of mattress users and owners.

U.S. Pat. No. 2,879,523 issuing to A. Klassen et al on Mar. 31, 1959, discloses a mattress construction comprising straps which extend transversely across the top and bottom portions of two side by side mattresses. The users must repose upon the transverse straps, which is uncomfortable, and the user's arms and legs can become entangled in the transverse straps.

U.S. Pat. No. 4,611,804 issuing to G. Addair on Sep. 16, 1986 discloses a mattress exercise apparatus, wherein a plurality of transverse and longitudinal straps encircle a single mattress, to support a plurality of exercise apparatus thereon.

U.S. Pat. No. 3,157,889 issuing to M. Chanko on Nov. 24, 1964 discloses the conversion of twin beds to a double bed with the use of a bridge strip extending the length of adjoining mattresses. A central rib extends the length of the bridge strip. No provision is provided to keep the mattresses from separating during use.

U.S. Pat. No. 3,225,363 issuing to B. Kirsch on Dec. 28, 1965 is representative of prior art disclosing the joining of adjacent bed framework by mechanical means, such as a releasable catch.

SUMMARY OF THE INVENTION

The mattress joining apparatus comprises a seam protector sized to extend the length of a mattress, and to extend over opposing ends of the mattress. A first mattress strap is secured to one end of the seam protector and a second mattress strap is secured to the opposite end of the seam protector. The first and second mattress straps are each sized to extend across the width of the first and second ends of the adjacent mattresses, and to extend at least halfway along the length of the first and second adjacent mattresses. A first releasable securement means is provided to secure one end of the first mattress strap with one end of the second mattress strap. A second releasable securement means is provided to secure the opposite end of the first mattress strap with the opposite end of the second mattress strap. The first and second mattress straps are secured about the thickness of the adjacent first and second mattresses, with the seam protector extending over the adjacent length of the first and second mattresses. The seam protector may alternetly extend to also overlap the thickness of each end of the box springs A first box springs strap may also be secured to one end of the seam protector in spaced relation from the first mattress strap, and a second box springs strap may also be secured to the opposite end of the seam protector in spaced relation from the second mattress strap. The first and second box spring straps are sized to be secured about the first and second box springs, and to be secured by third and fourth releasable securement means. The first and second mattress straps may be sized to extend about a bolster to one end of the first and second mattresses, to extend the length of the adjacent first and second mattresses. Releasable loops may be adapted to secure each rolled up mattress and box springs straps in proximity to the seam protector, which may be rolled into a compact package for ease of transport or storage.

The above mentioned and other features and objects of the invention, and the manner of attaining them will be best understood by reference to the following description of an embodiment of the invention, when considered in conjunction with the accompanying drawings:

DESCRIPTION OF THE PREFERRED EMBODIMENTS

Figure 1:
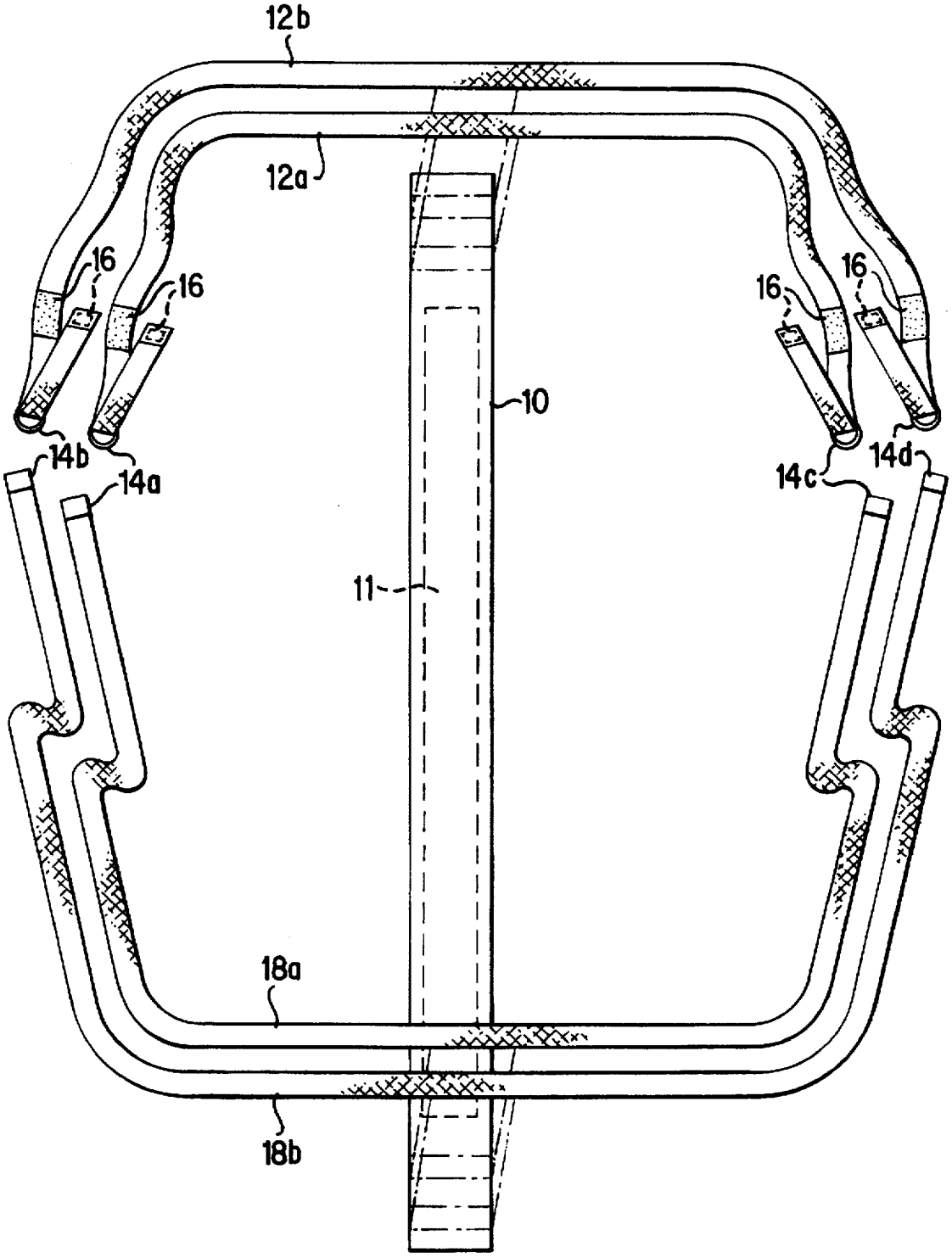
FIG. 1 is a top perspective view showing the basic parts of the apparatus.
Figure 2:
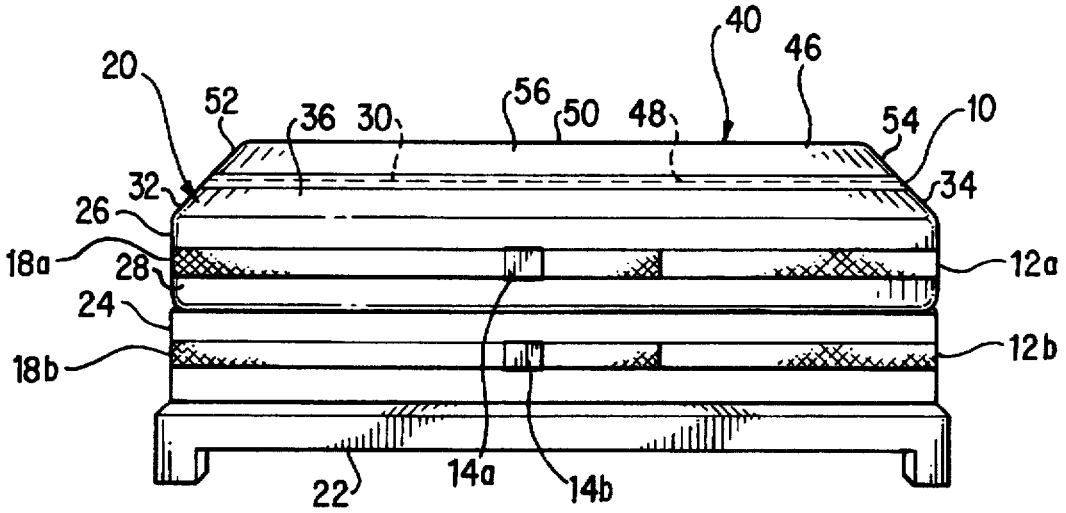
FIG. 2 is a side view showing the apparatus in place upon two adjacent mattresses.

In discussing a preferred embodiment of the invention, illustrated in drawing FIGS. 1–10, specific terminology will be resorted to for the sake of clarity. However, the invention is not intended to be limited to the specific terms or materials, and it is to be understood that each specific term/material includes all technical equivalents which operate in a similar manner to accomplish a similar purpose. The invention is to be used with two twin or single beds, 20, 40 which are pushed together. The first bed 20 typically comprises a first framework 22, a first box springs 24 and a first mattress 26. The first bed 20 typically has a first side 28, a second side 30, a first end 32, a second end 34, a first top 36 and a first bottom 38.

The second bed 40 typically also comprises a second framework 42, a second box springs 44 and a second mattress 46. The second bed 40 typically has a third side 48, a fourth side 50, a third end 52 and a fourth end 54, a second top 56 and a second bottom 58.

To join the first bed 20 and the second bed 40 together to form a larger bed 60, the second side 30 of the first bed 20 and the third side 48 of the second bed 40 are placed adjacent to each other.

As shown in FIG. 1, a seam protector 10 is placed across the seam 62 formed by the second side 30 of the first bed 20 and the third side 48 of the second bed 40. The seam protector 10 extends the length of the first and second beds 20, 40, and further extends across the first and third ends 32, 52 and the second and fourth ends 34, 54 of the first and second mattresses 26, 46. In an alternate embodiment, the seam protector 10 farther extends near the first and third ends 32, 52 and the second and fourth ends 34, 54 of the first and second box springs 24, 44.

The seam protector 10 is preferably made of a comfortable, cushioning material, such as a sherpa or lambs wool, but can be constructed of any soft material found in the market place that is washable and does not create a thick seam. The edges of the seam protector 10 are preferably sewn to prevent fraying.

Figure 5:
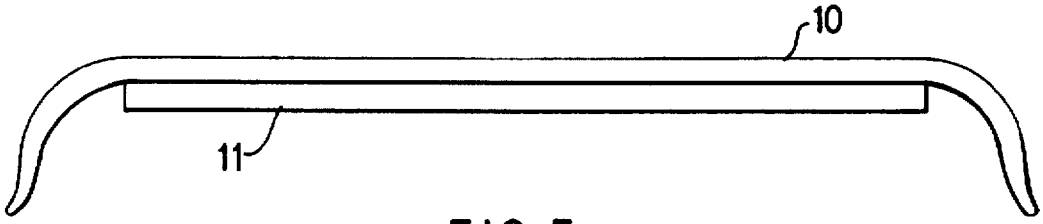
FIG. 5 is a side view of the seam protector showing a cushioning material attached to the seam protector.

As best shown in FIG. 5, an added cushioning material 11 may be attached to the underside of the seam protector 10. Alternately, the seam protector 10 may fold over the cushioning material 11, to enclose the cushioning material 11 therebetween. A pocket may also be formed in the seam protector to receive the cushioning material 11 therein. The cushioning material 11 is located so that it covers at least a portion of the first and second top portions 36, 56 of the first and second beds 20, 40 along the mattress seam 62. The cushioning material 11 preferably extends the full length of the second and third sides 30, 48 of the first and second beds 20, 40 along the mattress seam 62.

The cushioning material 11 is preferably made of Dacron, foam or similar material typically used for padding. The seam protector 10 may be adapted for use with or without cushioning material 11, to suit manufacturing and user preference. Alternately, the cushioning material 11 may also be a flexible strip of material, such as a thin, flat plastic. The cushioning material 11 may be sized to cover any mattress welting (not shown), even to cover the entire first and second top portions 36, 56 of the first and second beds 20, 40. The cushioning material 11 may be rectangular in shape, or molded in any suitable shape, such as a V-shaped foam material. The seam protector may be cut with V-shaped or S-shaped edges to suit manufacturing preference.

The first and second mattress straps **12*a* and 18*a* may be made of a pliable, durable, washable material, which does not substantially stretch or give way when normal man-made pressure is applied. The first mattress strap 12*a* is sown, or otherwise secured by any known means, to one end of the seam protector 10**.

The second mattress strap **18*a* is sown, or otherwise secured by any known means, to the opposite end of the seam protector 10. Preferably, the first and second mattress straps 12*a*, 18*a* are secured to opposing ends of the seam protector at right angles, with equal lengths extending on each side of the seam protector 10**.

In an alternate embodiment, the seam protector 10 extends at least partially along the first and second ends 32, 34 and the third and fourth ends 52, 54 of the first and second beds 20, 40. Third and fourth box springs straps **12*b*, 18*b* are secured in spaced relation from the first and second mattress straps 12*a* and 18*a*. The first and second mattress straps 12*a*, 18*a* are positioned to extend about the middle portion of the sides of the first and second mattresses 26, 46**.

The first and second box springs 24, 44 are secured together with the third and fourth box springs straps **12*b*, 18*b* positioned about the middle portion of the sides of the first and second box springs 24, 44. The first and second mattress straps 12*a*, 18*a* are each of a length suitable to extend across one end of the first and second beds 20, 40, and further to extend at least half way along the first side 28 of the first mattress 26, and at least halfway along the fourth side 50 of the second mattress 46. Preferably, the first and second mattress straps 12*a*, 18*a* encircle the first and second mattresses 26, 46 and extend at least three inches to 12 inches further, for ease of releasably securing the first and second mattress straps 12*a*, 18*a* together about the first and second mattresses 26, 46 with a suitable releasable fastening means 14*a*, 14*b***.

The third and fourth box springs straps **12*b*, 18*b* are of a length suitable to extend across one end of the first and second box springs 24, 44, and farther to extend at least half way along the first side 28 of the first box springs 24, and at least halfway along the fourth side 50 of the second box springs 44. Preferably the third and fourth box springs strap 12*b*, 18*b* encircles the first and second box springs 24, 44, and extends at least three to twelve inches further for ease of releasably securing the third and fourth box springs strap 12*b*, 18*b* together about the first and second box springs 24, 44 with a suitable releasable fastening means 14*c*, 14*d*. The length of extension of the straps 12*a* and 12*b* and 18*a* and 18*b* would depend on what type of fastening means 14*a*–*d*** is utilized.

Figure 3A:
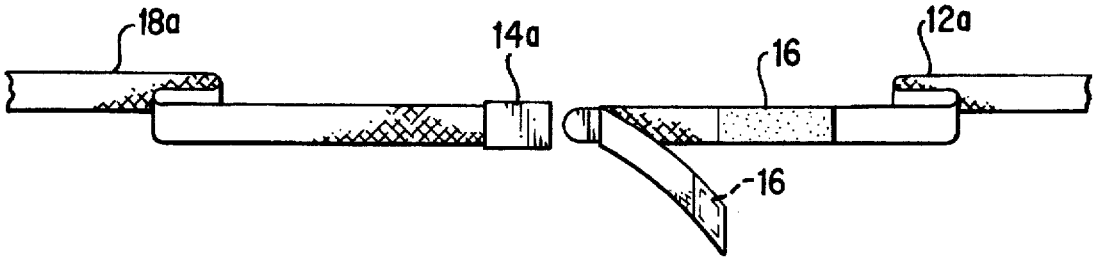
FIG. 3A is a close up view of one releasable securement means.
Figure 3B:
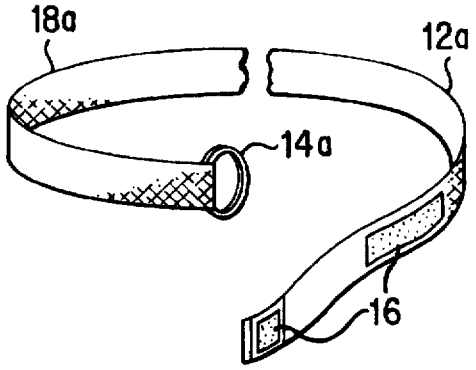
FIG. 3B is a close up view of an alternate releasable securement means.
Figure 3C:
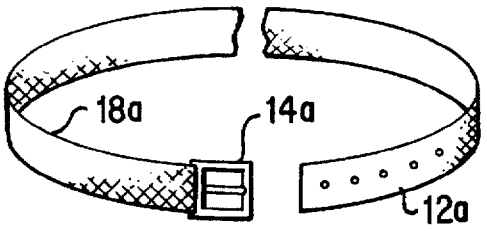
FIG. 3C is a close up view of yet another alternate releasable securement means.

The releasable fastening means 14 may be in the form of a buckle as shown in FIG. 3A, or may be any known releasable fastening means 14, such as a ring shown in FIG. 3B, or a hook and loop fastening means. There are also various types of male/female buckling or connecting devices sold at fabric and upholstery stores, such as buttons, snaps, hooks, etc. which may also be used as the fastening means **14 *a*–*d*. While FIG. 5 shows both mattress straps 12*a*, 18*a*, and box springs straps 12*b*, 18*b*, it is noted that only one set of straps 12*a*, 18*a*** are needed in a preferred embodiment.

The fastening means 14 is provided to adjustably position the straps **12*a*, 18*a* about the sides of adjacent first and second mattress 26, 46, and to releasably secure the straps 12*a*, 18*a* about the first and second mattresses 26, 46. Likewise, additional fastening means 14 may be used to position the straps 12*b*, 18*b* about the sides of adjacent first and second box springs 24, 44, and to releasably secure the straps 12*b*, 18*b* about the first and second box springs 24, 44**.

Figure 6:
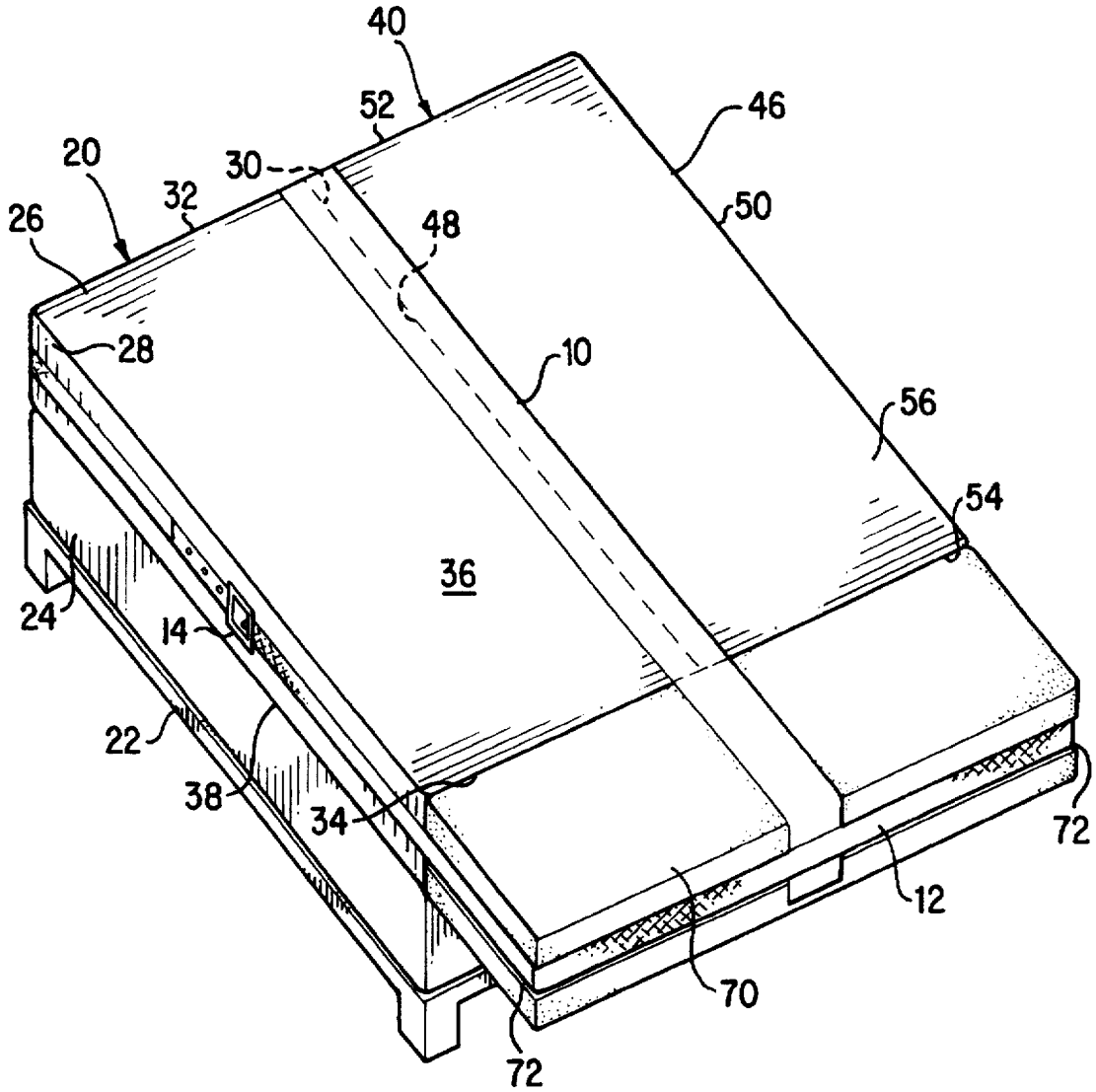
FIG. 6 is a perspective view of adjacent beds with a bolster secured at one end of the mattresses.

Any known binding means 16, such as hook and loop fasteners, snaps, buttons, loops, and other known commercially available releasable fastening devices may be used to secure the loose ends of the straps **12*a*, 12*b*, 18*a*, 18*b*** so they do not hang loose.

Where additional length is desired, to convert two adjacent beds 20, 40 to the length of a king sized bed, a bolster 70 may be provided for releasable securement to the first end 32, 52, or second end 34, 54 of the adjacent beds 20, 40. The bolster 70 may be secured with the mattress straps **12*a*, 18*a*, as shown in FIG. 6. When a bolster 70 is used, the seam protector will be extended by at least five inches, and the length of the mattress straps 12*a* or 18*a* will also be extended accordingly. The bolster 70 may be sized to extend the width of the first and second beds 20, 40, or may alternately be a separate bolster 70 for each of the first and second beds 20, 40**.

The bolster 70 is preferably made of a high density foam, having an indentation along one end, sized to receive the mattress straps **12*a* or 18*a* at about the midpoint of the bolster 70**, with the indentation deep enough to keep the straps from moving, as shown in FIG. 6. The bolster 70 could be enclosed in material such as nylon, or other suitable material which can be cleaned. Alternately, the bolster 70 may be held in place by the straps 12*a* or 18*a* with a suitable binding material 17, such as hook and loop fasteners, snaps, etc. The bolster 70 may include an angled bottom, which provides added support.

This invention is for the purpose of combining two adjacent twin or single mattresses 20, 40 without the fear that the mattresses will separate during use. The seam protector 10 is placed over the seam formed by the two mattresses pushed together, with the overhang falling equally over both ends 32, 34 and 52, 54. The purpose of the seam protector 10 is to cover the mattress seam and welting for better sleeping comfort. The seam protector 10 also serves to fill some of the slope between the two mattresses 20, 40. The seam protector 10 further serves to position the straps 12*a*, 18*a* at approximately the midpoint of the height of the first and second mattresses 26, 46.

Where box springs straps 12*b* and 18*b* are used, straps 12*b* and 18*b* are positioned at approximately the midpoint of the height of the first and second box springs 24, 44. Were the straps not held in position by the seam protector 10, it would be very cumbersome and difficult to position the straps 12*a*, 12*b* and 18*a*, 18*b* around an object as large as two mattresses 26.46, or box springs 24, 44, particularly if one person were doing it alone.

The straps 12*a*, 18*a* are preferably releasably secured by the fastening means 14, one side at a time. After releasably securing the straps 12*a*, 18*a* along the second side, the straps 12*a*, 18*a*, are pulled and releasably secured tightly about the first and second mattresses 26, 46. The excess length of strap 12*a* or 18*a* is then releasably secured with a suitable binding means 16 to the strap 12*a*, or 18*a*, if needed.

The mattress straps 12*b*, 18*b* are preferably releasably secured by additional fastening means 14 one side at a time. After releasably securing the straps 12*b*, 18*b* along the second side, the straps 12*b*, 18*b* are pulled and releasably secured tightly about the first and second box springs 24, 44. The excess length of strap 12*b* or 18*b* is then releasably secured with a suitable binding means 16 to strap 12*b*, or 18*b*.

The purpose of the straps 12*a,b* and 18*a,b* are to connect the mattresses 26, 46 and box springs 24, 44 so that they will not separate during use. Separation during use is the main reason that great discomfort occurs when people, who are stuck with twin/single beds, but want to sleep together, are unsuccessful in creating one sleeping area by simply pushing their beds together.

Any variances in the size of the mattresses 26, 46 can be accommodated by adjusting the straps 12*a,b* and 18*a,b*, and excess strap can be held in place by the binding material 16. The binding/material 16 further serves as a second means to avoid slippage of the straps 12*a,b* and 18*a,b* during use.

When a bolster 70 is used, as shown in FIG. 6 the seam protector 10 is laid over the seam formed between the adjacent sides of the beds 20, 40, as previously disclosed. The bolster(s) 70 would then be placed at one end of the mattresses 32, 52 or 34, 54, with the top portion of the bolster 70 in line with the top portion 36, 56 of the first and second beds 20, 40. The seam protector would be positioned over the bolster 70 so that the strap 12*a* or 18*a* would be positioned at about the midpoint of the side of the bolster 70. Preferably, an indentation 72 is provided at the side of the bolster 70 to receive the strap 12*a* or 12*b*. The strap 12*a* or 18*a* would then be placed around the bolster 70 and secured about the first and second beds 20, 40, as previously noted.

When two twin/single beds are pushed together they form the approximate width of a king sized bed. Most often, the desire in pushing the beds together is for the purpose of people wishing to sleep together. However, sometimes the purpose is strictly for want of more sleeping room. In this case, the user may also wish to extend the length of the beds 20, 40 with a bolster 70, to provide additional length similar to a king sized bed.

Figure 7:
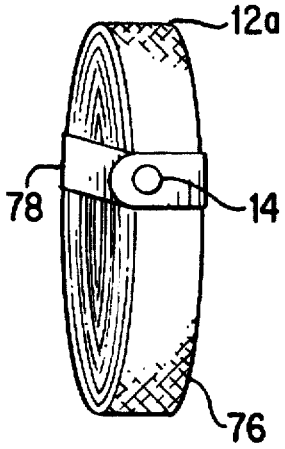
FIG. 7 is a view of one of the straps rolled up for ease of transport or storage.
Figure 8:
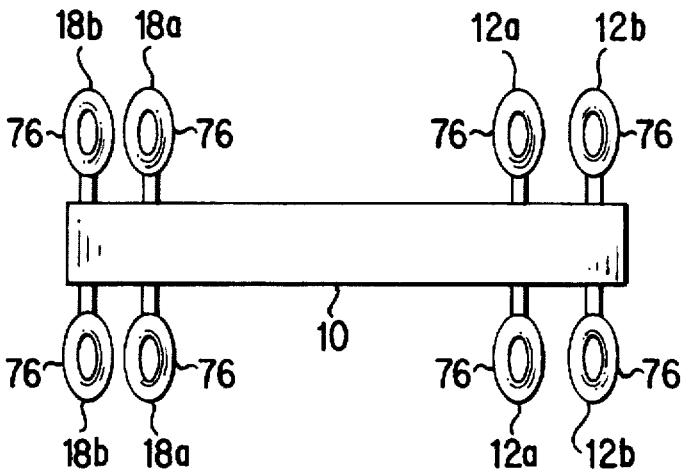
FIG. 8 is a top view of the apparatus, showing four straps rolled up for ease of transport or storage.
Figure 9:
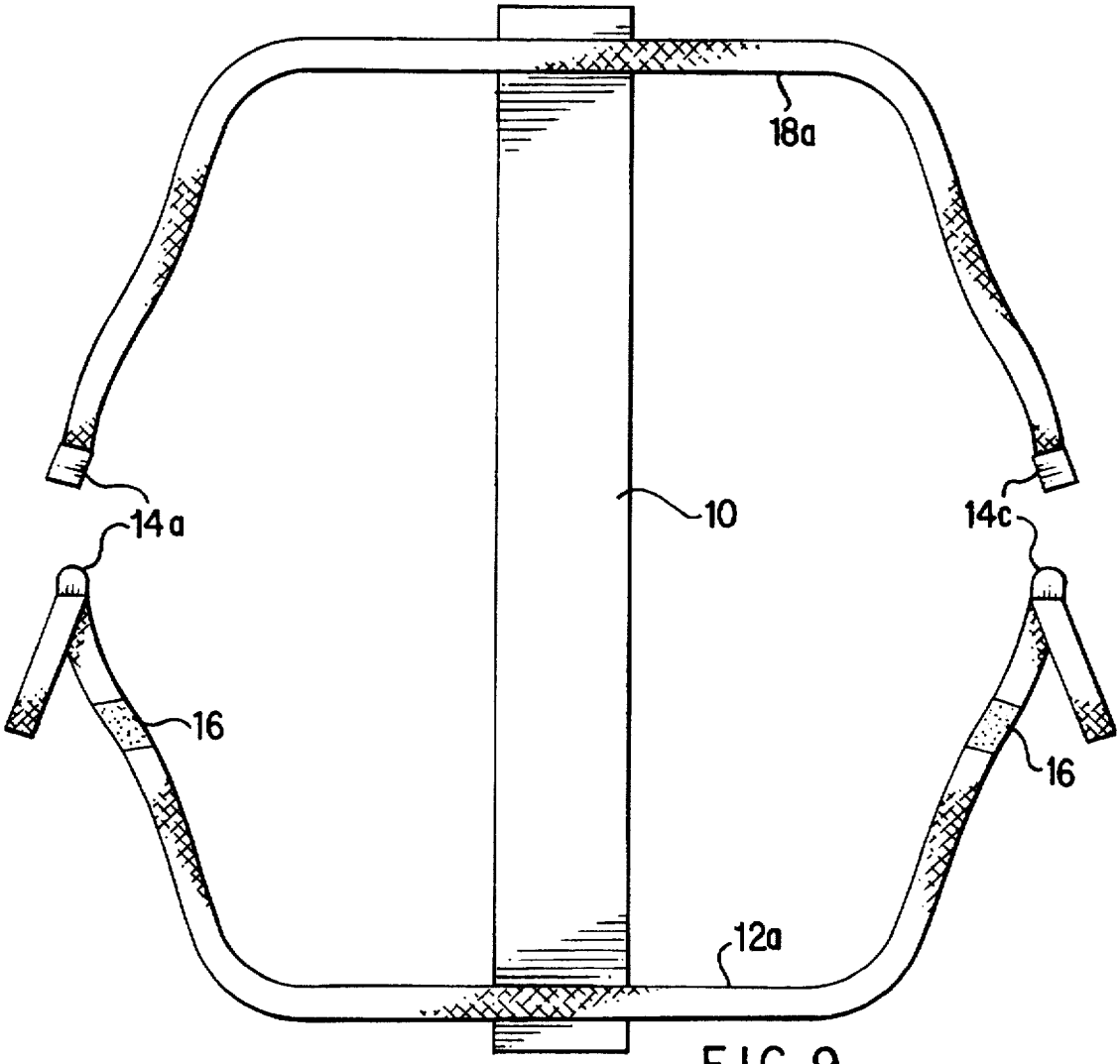
FIG. 9 is a top view of the apparatus shown in FIG. 1 without box spring straps.

The straps 12*a*, 12*b* and 18*a*, 18 be may be rolled up into loops 76 and secured with a suitable strip 78, as shown in FIG. 7. The strip 78 may be releasably secured to itself about each rolled up strap 12*a*, 12*b*, 18*a*, with a snap, catch, hook and loop, or other known releasable securement means.

Figure 4A:
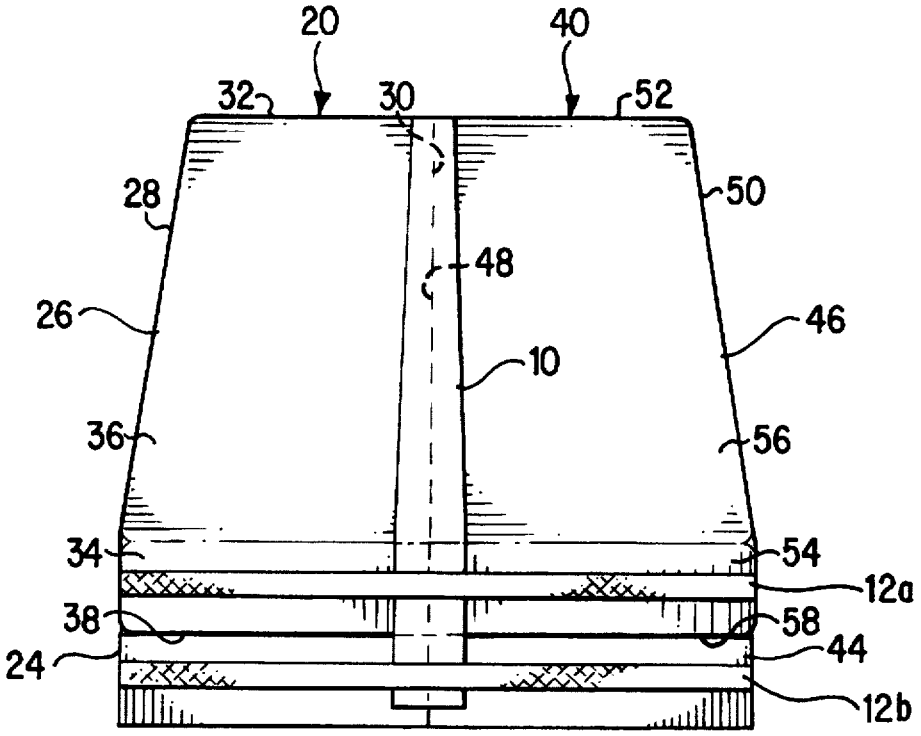
FIG. 4A is a front perspective view showing the apparatus securing two adjacent beds together with both mattress straps and box spring straps.
Figure 4B:
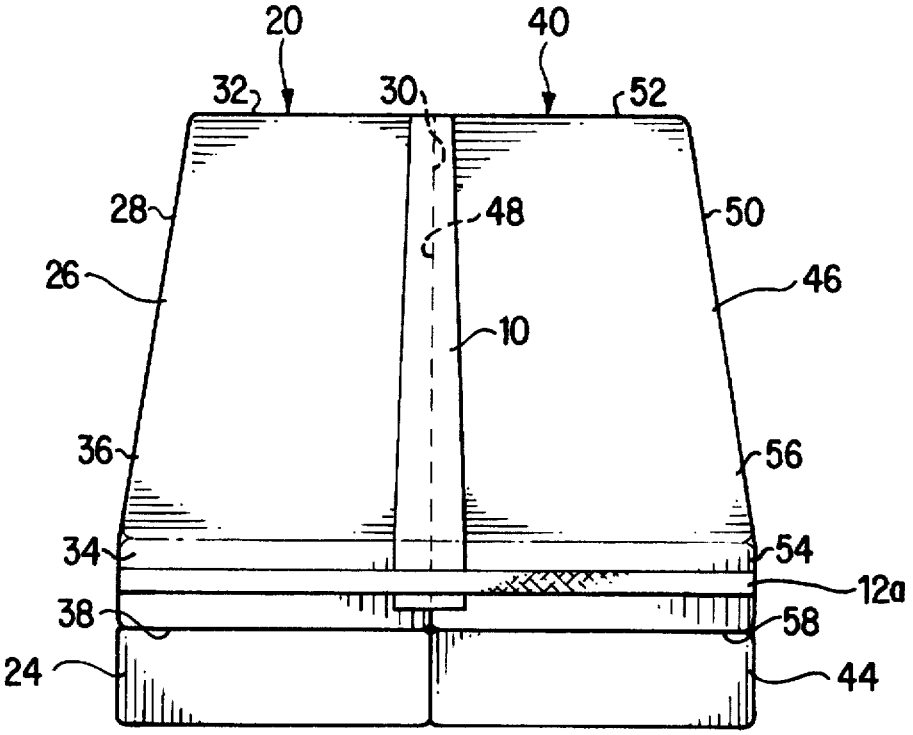
FIG. 4B is a front perspective view showing the apparatus securing two adjacent beds together with mattress straps.

As shown in FIG. 4B, the mattress connecting apparatus may comprise a seam protector having first and second mattress straps 12*a*, 18*a*, without the use of first and second box springs straps 12*b*, 18*b*. Alternately, one mattress strap 12*a* may be adapted to extend entirely around the first and second beds, for securement by a first releasable securement means.

While a specific embodiment of the invention has been shown and described herein for purposes of illustration, the protection afforded by any patent which may issue upon this application is not strictly limited to the disclosed embodiment, but rather extends to all structures and arrangements which fairly fall within the scope of the claims which are appended hereto.

I claim:

1. A mattress joining apparatus for releasably securing an existing first bed having a first mattress and a n existing second adjacent bed having a second mattress, the first and second mattresses joined together in side-by-side relation, comprising: a pliable seam protector having a first end and a second end, the length between the first end and the second end sized to extend beyond the length of the first and second mattress; the seam protector having a width sized to cover a seam formed by adjacent sides of the first mattress and the second mattress; a first mattress strap secured to the first end of the pliable seam protector, and a second mattress strap secured to the second end of the pliable seam protector, the first and second mattress straps sized to extend about the outer periphery of the first and second adjacent mattresses; and an adjustable fastening means to releasably secure the first mattress strap to the second mattress strap about the outer periphery of the first and second adjacent beds.

2. The mattress joining apparatus of claim 1, wherein a pocket is formed in the pliable seam protector, the pocket sized to extend substantially the length of the first and second mattress, and the pocket is adapted to receive a cushioning material therein.

3. The mattress joining apparatus of claim 2, wherein the cushioning material is selected from at least one of the following: Dacron, lambs wool, sherpa, open celled foam, closed cell foam, pliable plastic, woven fabric and non-woven fabric.

4. The mattress joining apparatus of claim 1, wherein the edges of the seam protector are sewn to prevent fraying during use.

5. The mattress joining apparatus of claim 1, wherein the pliable seam protector is adapted to cover the entire first and second top portions of the first and second mattresses.

6. The mattress joining apparatus of claim 1, wherein a third box spring strap is secured to the first end of the pliable seam protector in spaced relation from the first mattress strap, and a fourth box spring strap is secured to the second end of the pliable seam protector in spaced relation from the second mattress strap, the third and fourth box spring straps sized to extend around the outer periphery of the first and second adjacent beds, and at least one releasable fastening means is secured to the third box spring strap, and at least one releasable fastening means provides a releasable means of adjustable securement between the third box spring strap and the fourth box spring strap, to further aid in snugly securing the first and second adjacent beds together.

7. The mattress joining apparatus of claim 1, wherein the straps are made of a washable material.

8. The mattress joining apparatus of claim 1, wherein the straps are sized to encircle the first and second adjacent beds, and to extend from three inches to twelve inches further, for ease of releasably securing the first and second mattress straps together.

9. The mattress joining apparatus of claim 1, wherein the fastening means is selected from the following: hook and loop type fastening means, buckles, rings, snaps, buttons, and loops.

10. The mattress joining apparatus of claim 1, wherein any excess strap portion is releasably secured with a binding material to an adjacent strap portion.

11. The mattress joining apparatus of claim 1, wherein a bolster is secured to one end of the first and second adjacent beds, with at least one of the first and second mattress straps.

12. The mattress joining apparatus of claim 11, wherein an indentation is provided in the bolster to aid in securing the bolster to the beds with at least one of the first and second mattress straps.

13. The mattress joining apparatus of claim 1, wherein the first and second mattress straps are rolled into loops and releasably secured with a suitable strip for ease of transport or storage.

14. A mattress joining apparatus for releasably securing an existing first bed having a first mattress and a first box springs and an existing second adjacent bed having a second mattress and a second box springs; the first and second beds joined together in side-by-side relation, comprising: a pliable seam protector having a first end and a second end, the length between the first end and the second end sized to extend beyond the length of the adjacent first and second mattresses, the seam protector having a width sized to cover a seam formed by adjacent sides of the first mattress and the second mattress; a first mattress strap secured to the first end of the pliable seam protector, and a second mattress strap secured to the second end of the pliable seam protector, the first and second mattress straps sized to extend about the outer periphery of the first and second adjacent mattresses; an adjustable fastening means to releasably secure the first mattress strap to the second mattress strap about the outer periphery of the first and second adjacent mattresses; a third box springs strap secured to the first end of the pliable seam protector in spaced relation from the first mattress strap; a fourth box springs strap secured to the second end of the pliable seam protector in spaced relation from the second mattress strap; an adjustable fastening means to releasably secure the third box springs strap to the fourth box springs strap about the outer periphery of the first and second adjacent box springs.

15. The mattress joining apparatus of claim 14, wherein a pocket is formed in the pliable seam protector, the pocket sized to extend substantially the length of the first and second mattress, and the pocket is adapted to receive a cushioning material therein.

16. The mattress joining apparatus of claim 15, wherein the cushioning material is selected from at least one of the following: Dacron, lambs wool, sherpa, open celled foam, closed cell foam, pliable plastic, woven fabric and non-woven fabric.

17. The mattress joining apparatus of claim 14, wherein the fastening means is selected from one of the following: a hook and loop type fastening means, a buckle, a ring, snaps, buttons, and loops.

18. The mattress joining apparatus of claim 14, wherein a bolster is secured to one end of the first and second adjacent beds and held in position by one of the first and second mattress straps.

19. A mattress joining apparatus for releasably securing an existing first bed having a first mattress with first and second ends and an existing second adjacent bed having a second mattress with first and second ends, the first and second mattresses joined together in side-by-side relation, comprising: a pliable seam protector having a first end and a second end, the length between the first end and the second end sized to extend beyond the length of the first and second mattresses; the seam protector having a width sized to cover a seam formed by adjacent sides of the first mattress and the second mattress; a first mattress strap secured to the first end of the pliable seam protector, and a second mattress strap secured to the second end of the pliable seam protector, the first and second mattress straps sized to extend about the outer periphery of the first and second adjacent mattresses; an adjustable fastening means to releasably secure the first mattress strap to the second mattress strap about the outer periphery of the first and second adjacent beds; and a bolster secured to one of the first and second ends of the first and second adjacent beds, and releasably secured thereto with one of the first and second mattress straps.

20. The mattress joining apparatus of claim 19, wherein the pliable seam protector includes cushioning material selected from at least one of the following: Dacron, lambs wool, sherpa, open celled foam, closed cell foam, pliable plastic, woven fabric and non-woven fabric.

* * * * *